US005850739A

United States Patent [19]

Masnoi

[11] Patent Number: 5,850,739

[45] Date of Patent: Dec. 22, 1998

[54] STEAM TURBINE POWER PLANT AND METHOD OF OPERATING SAME

[76] Inventor: Sergey Alexandrovich Masnoi, Metallistov pr.105, flat 13, 195197, Saint-Petersburg, Russian Federation

[21] Appl. No.: 737,883

[22] PCT Filed: Jun. 1, 1994

[86] PCT No.: PCT/RU94/00119

§ 371 Date: Nov. 27, 1996

§ 102(e) Date: Nov. 27, 1996

[87] PCT Pub. No.: WO95/33127

PCT Pub. Date: Dec. 7, 1995

[51] Int. Cl.[6] ..... F01K 7/34

[52] U.S. Cl. ..... 60/653; 60/679

[58] Field of Search ..... 60/646, 679, 653, 60/657, 666

[56] References Cited

U.S. PATENT DOCUMENTS 4,571,935 2/1986 Rice ..... 60/39.141

4,598,551 7/1986 Dimitroff, Jr. et al. ..... 60/646

*Primary Examiner*—Noah P. Kamen

*Attorney, Agent, or Firm*—Cesari and McKenna, LLP

[57] ABSTRACT

A method of operating a steam turbine facility which includes a turbine with at least a high pressure or a medium pressure cylinder and a steam reheater connected to the turbine and a valve-control bypass line connected across the reheater. During nominal and steady state operating modes of the facility, cold, steam leaving the turbine's high or medium pressure cylinder is split into two streams controlled by the valves. One stream amounting to 90%–50% of the steam leaving the turbine is fed to the bypass line while the other stream amounting to 10%–50% thereof is fed to the reheater for heating to a temperature of 650°–850° C. at a pressure not exceeding 0.1–1 Mpa. The streams of reheated and bypass steam are then merged and then mixed to form a single combined stream which is fed back to the turbine. The method enhances the cost effectiveness and reliability of the facility by reducing to zero the steam moisture once the expansion process in the turbine is complete.

3 Claims, 2 Drawing Sheets

STEAM TURBINE POWER PLANT AND METHOD OF OPERATING SAME

FIELD OF THE INVENTION

The invention relates to the steam power field and, more particularly, it can be used in reheat steam turbine power plants as well as in non-reheat steam turbine power plants during their retrofitting by introducing an additional steam reheating.

DESCRIPTION OF PRIOR ART

The method of operating a steam turbine power plant is known to those skilled in the art and according to which steam, expanded in the first turbine blade stages, is supplied from the turbine to the steam reheaters where additional heat is added to it. After the steam is reheated, the steam is returned to the turbine to expand through the next blade stages (see, for example, V. Ya. Rizhkin "Steam electrical power stations", M-L, Energy, 1967, p. 30–36, 50–54).

The steam turbine power plant is known to those skilled in the art to implement the above-mentioned known method. The steam turbine power plant generally comprises a boiler with a primary superheater, a steam turbine consisting of a high pressure cylinder (HPC), an intermediate pressure cylinder (IPC) and a low pressure cylinder (LPC), boiler reheaters connected to the turbine with steam pipes, an electrical generator, a condenser, water pumps and a feed water heating system connected to the boiler with piping (see, for example, V. Ya. Rizhkin "Steam electrical power stations", M-L Energy, 1967, p. 30, FIG. 3-1; p. 35, FIG. 3-3; p 67, FIGS. 6-4, 6-5).

When operating system turbine power plant, the said method and the steam turbine power plant allow the diagram steam moisture content to be reduced at the end of the expansion process in the turbine from 12% . . . 15% to 7% . . . 8% in comparison with a non-reheat steam turbine power plant thereby increasing the efficiency and reliability of the steam turbine power plant.

However, the terminal moisture existing there reduces the efficiency and reliability of these steam turbine power plants and in addition to this, the said steam turbine power plants have a reduced flexibility under startup-shutdown conditions due to a considerable difference between the steam temperature entering from the reheaters and the turbine metal temperature.

The nearest known method to the invention is the method of operation of a steam turbine power plant according to which, during startup conditions up to the rated load and before supplying steam from the HPC to the IPC, the cold steam leaving the HPC is divided into two flows: one flow is supplied to the reheater for reheating, while the other flow is directed to a bypass line bypassing the reheater. Both steam flows are controlled by a control element provided in the bypass line. Then, the bypassed cold steam is mixed with the reheated steam into one flow and this mixture is supplied to the turbine. After the rated load has been achieved and under the next steady state operation conditions, the cold steam through the bypass line is stopped by closing the control element and the steam turbine power plant is operated with one steam flow from the HPC to the IPC that was exposed to reheating in the reheater (see "Typical Instruction for starting the turbine from various thermal conditions and for shutting down 300 MW Units with LMZ's 300 MW turbine K-300240 working in a Unit principle", M. Sojuztechenergo, 1980, p. 12").

The nearest known plant to the invention is a steam turbine power plant for implementing the above said known method consisting of a boiler with the primary superheater, a steam turbine comprising a high pressure cylinder (HPC), an intermediate pressure cylinder (PC), a low pressure cylinder (LPC), a reheater connected to the turbine with steam piping, a bypass line with a control element bypassing the reheater, an electrical generator, a condenser, water pumps and a feed water heating system connected to the boiler with piping (see USSR Patent No. 134030, class F 01 D 17/00 published in 1987).

The said known method and steam turbine power plant expedite the heating and cooling processes in the turbine during startups and shutdowns by reducing the temperature difference between the steam entering from the reheater and the turbine metal temperature.

However, at the rated and other stationary steady-state operating conditions, that method and that steam turbine power plant have a reduced efficiency because considerable moisture appears downstream from the last stage of the turbine which is not removed. That residual moisture reduces turbine efficiency and causes erosion wear in the moving turbine blades.

SUMMARY OF THE INVENTION

Accordingly, it is an object of this invention to increase the efficiency and reliability of a steam turbine power plant by eliminating the erosion wear of the moving turbine and diminishing to zero the diagram steam moisture content at the end of the steam expansion process in the turbine.

Briefly, in accordance with my method of operating a steam turbine power plant, the plant is provided with a cold steam supply from the turbine to the reheater and a reheated steam supply to the turbine. The cold steam leaving the turbine is divided into two flows when operating the steam turbine power plant at rated and other steady-state operating conditions. These flows are distributed by means of control elements and directed as follows: one flow in amounts of 90% . . . 50% of the steam flow leaving the turbine is directed to the bypass line of the reheater, the second flow in amounts of 10% . . . 50% is supplied to the reheater. In the reheater, the steam is heated to a temperature of 650° C. . . . 850° C. at a maximum pressure of 0.1 Mpa . . . 1 Mpa. Then the reheated steam flow and the cold bypassed steam flow are combined to one flow and mixed in a steam-mixing vessel before being returned to the turbine.

The steam turbine power plant for implementing my method comprises a boiler with a primary superheater, a steam turbine consisting of a high pressure cylinder, an intermediate pressure cylinder, a low pressure cylinder, a reheater connected to the turbine with steam piping, a bypass line with a control element, a valve bypassing the reheater, an electrical generator, a condenser, water pumps and a feed water heating system connected to the boiler with piping. It also includes at least with one steam-mixing-vessel mounted in the steam line from the reheater and in particular between the low pressure turbine and the bypass line across the reheater.

DESCRIPTION OF PREFERRED EMBODIMENT

Figure 1:
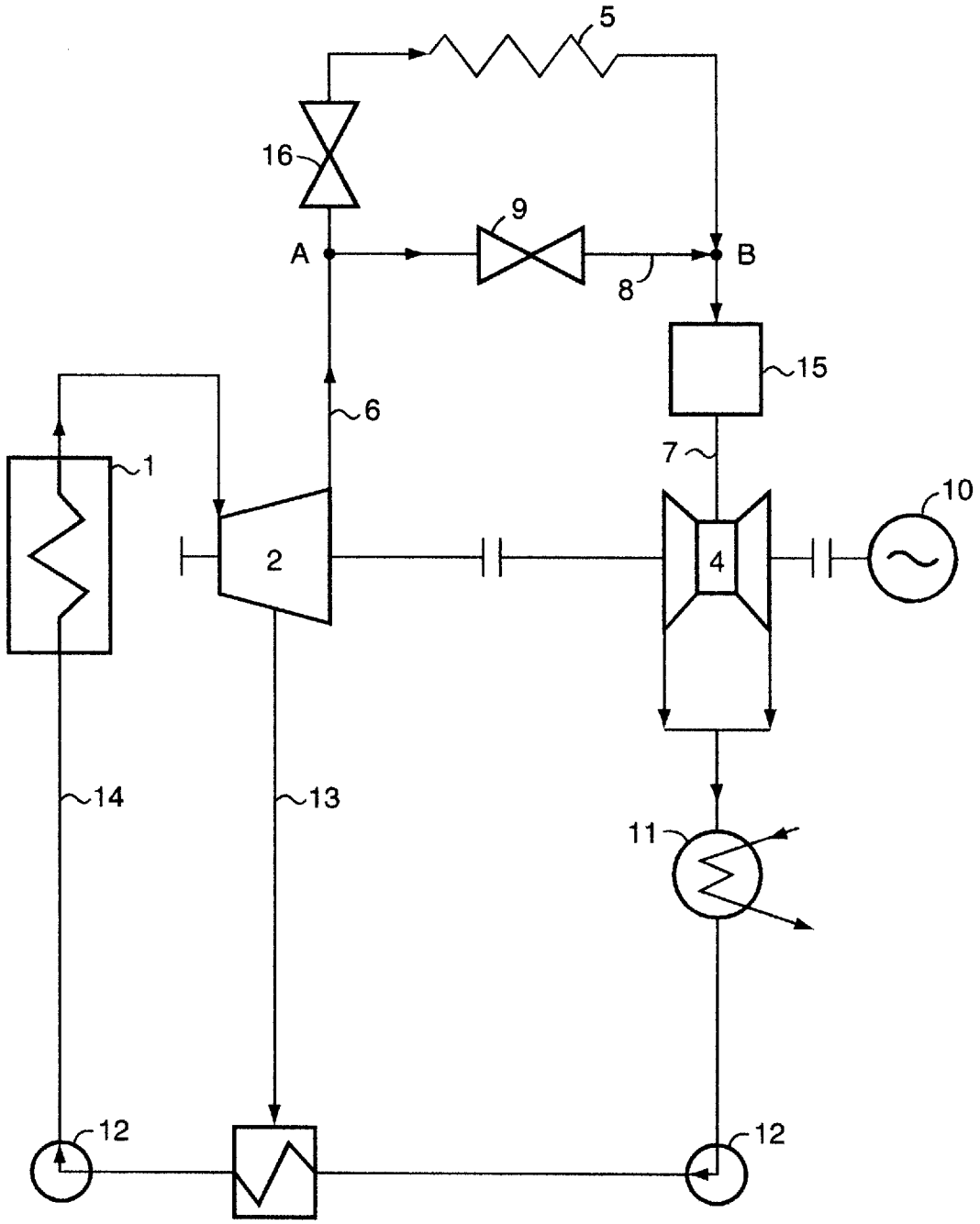
FIG. 1 shows a schematic diagram of a steam turbine power plant for practicing my method with a two-cylinder steam turbine.
Figure 2:
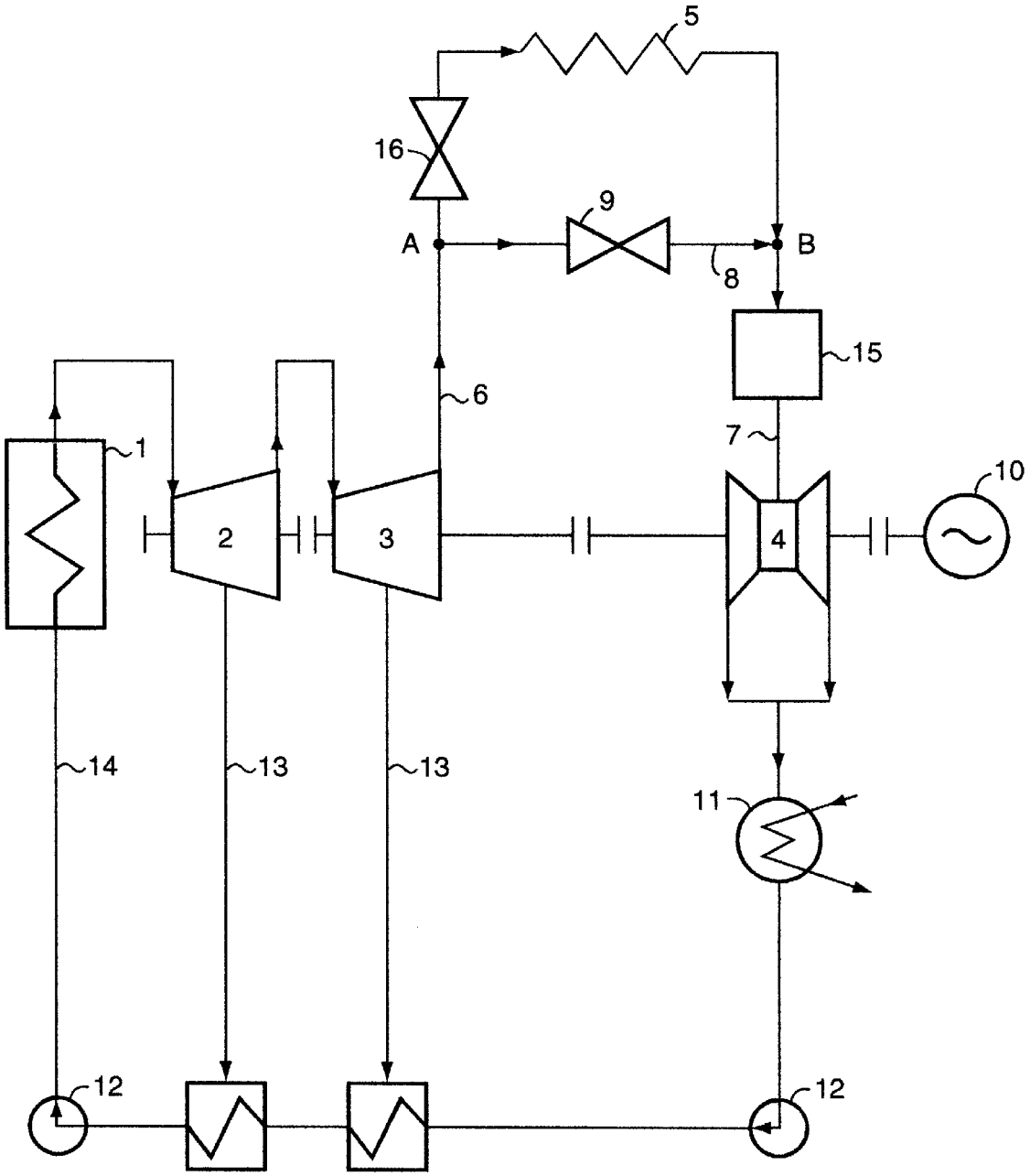
FIG. 2 shows a schematic diagram of a steam turbine power plant for carrying out my method with a three-cylinder steam turbine.

Referring to FIGS. 1 and 2, my steam turbine power plant comprises a boiler 1 with a primary superheater, consisting of a high pressure cylinder (HPC) 2, an intermediate pressure cylinder (IPC) 3, (FIG. 2 only), a low pressure cylinder (LPC) 4, a reheater 5 connected to the turbine with piping 6,7, a bypass line 8 provided with a control element, namely a valve 9, for bypassing the reheater, an electrical generator 10, a condenser 11, water pumps 12, a feed water heating system 13 connected to the boiler 1 with piping 14, a steam mixing vessel 15 disposed in steam piping 7 between LPC 4 and the bypass line 8, an additional control element, namely a valve 16, disposed in piping 6 between the bypass line 8 and the reheater 5.

The steam turbine power plant could also be provided with an additional reheater 5 and a bypass line 8 with the control valve 9 disposed between HPC 2 and IPC 3 (which is not shown in FIG. 2).

The invention is realized in the following way. After startup procedures when the electrical generator 10 has achieved a rated load and during subsequent steady-state operation conditions of the steam turbine power plant, the cold steam leaving the turbine is divided in two flows at the dividing point A in the piping 6. These two flows are distributed by means of the control elements, namely valves 9, 16, and directed as follows: one steam flow in amounts of 90% . . . 50% of the steam flow leaving the turbine is directed to the bypass line 8, the other flow in amounts of 10% . . . 50% is supplied to the reheater 5 where the steam is heated to a temperature of 650° C. . . . 850° C. at a maximum pressure of 0.1 Mpa . . . 1 Mpa. Then the reheated steam flow and the cold bypassed steam are combined into one flow at the point B in the piping 7 and mixed in the steam-mixing vessel 15 before being returned to the turbine.

In comparison with the prior art methods described at the outset, the method of operating a steam turbine power plant in accordance with this invention increases the efficiency and reliability of the steam turbine power plant by increasing the turbine efficiency and eliminating the erosion wear of the moving turbine blades. More particularly, the steam supply in the range of 10%–50% of the steam flow leaving the turbine through the reheater 5 provides a possibility of reducing the pressure in the reheater 5 (at the same steam flow volume and velocity) up to 0.1 Mpa . . . 1 Mpa by reducing the weight flow by 2 . . . 10 times that. This in turn makes it possible to reduce the stress level with the same strength margin in the components of the reheater 5 and to increase the temperature up to 650° C. . . . 850° C. A special mixing vessel 15, for example of an aerodynamic or mechanical type, provides an equal temperature steam mixture at a short section of the piping 7 and excludes the possibility of temperature disturbances in the turbine components and parts. The additional control valve 16 provides a normal operation of the steam turbine power plant when the valve 9 fails in an emergency that increases the operational reliability of the steam turbine power plant.

When practicing the invention in a 200 MW steam turbine power plant having initial steam conditions of 13 Mpa, 540° C. and an additional reheater at 2.1 Mpa, 540° C. (FIG. 2), a zero moisture content is provided at the end of the steam expansion process in the turbine. This occurs when the weight of steam flow through the reheater 5 is equal to 25% of the steam flow leaving the turbine at a pressure of 0.12 Mpa and temperature of 650° C. When using the invention in a 100 MW steam turbine power plant having initial steam conditions of 9 Mpa, 535° C. (FIG. 1), a zero moisture content is provided at a steam flow through the reheater 5 in an amount of 35% of the steam flow leaving the turbine with a pressure of 0.2 Mpa and a temperature of 650° C.

As a result, the efficiencies of the FIGS. 1 and 2 steam turbine power plants are increased by 1.5% and 4% respectively and there is no need to implement other design or technological measures and to carry out repairs associated with erosion wear and failure of the turbine blades.

From an analysis of turbine operating conditions it was found that steam becomes moist downstream from the turbine last stage when the steam flow through the reheater 5 is less than 10% and steam becomes superheated by more than 60° C. when the steam flow is more than 50% of that which is inadmissible from the operational conditions of the steam turbine power plant.

What is claimed is:

1. A method of operating a steam turbine power plant of the type including a turbine, a reheater connected to the turbine, a supply of cold steam from the turbine and a supply of reheated steam to the turbine, during rated and steady-state operating conditions of the plant, said method comprising the steps of dividing the supply of cold steam from the turbine into first and second flow streams;

directing the first flow stream amounting to 90%–50% of the total supply from the turbine to the bypass line;

directing the second flow stream amounting to 10%–50% of the total supply from the turbine to the reheater for heating to a temperature of 650°–850° C. at a maximum pressure of 0.1–1.0 Mpa, and combining the first and second flow streams from the bypass line and the reheater into a single combined stream which constitutes said supply of reheated steam to the turbine.

2. The method defined in claim 1 and including the additional step of providing at least one steam mixing device between the turbine and the bypass line to mix the streams from the bypass line and the reheater before they are supplied to the turbine.

3. A method of operating a steam power plant of the type including a turbine with high, medium and low pressure cylinders, a reheater connected across the medium and low pressure cylinders and a bypass line connected across the reheater, during rated and steady-state operating conditions, said method comprising the steps of dividing the supply of cold steam from the turbine into first and second flow streams;

directing the first stream to the bypass line;

directing the second stream to the reheater;

regulating the first and second flow streams so that from 90%–50% of the supply of cold steam from the turbine flows through the bypass line and from 10%–50% of the supply of cold steam from the turbine flows through the reheater;

controlling the reheater so that the second stream is heated to a temperature of 650° to 850° C. at a pressure not exceeding 0.1–1.0 Mpa;

combining and mixing flow streams from the bypass line and reheater into a combined stream, and conducting the combined stream to the low pressure cylinder as said supply of reheated steam to the turbine.

* * * * *